US007474936B2

(12) United States Patent
Toshiaki et al.

(10) Patent No.: US 7,474,936 B2
(45) Date of Patent: Jan. 6, 2009

(54) FLAT KNITTING MACHINE, KNITTING PROGRAM, AND METHOD FOR GENERATING KNITTING PROGRAM

(75) Inventors: Morita Toshiaki, Wakayama (JP); Kaito Hideya, Wakayama (JP); Komura Yoshiyuki, Wakayama (JP)

(73) Assignee: Shima Seiki Manufacturing, Ltd., Wakayama-shi, Wakayama (JP)

( * ) Notice: Subject to any disclaimer, the term of this patent is extended or adjusted under 35 U.S.C. 154(b) by 468 days.

(21) Appl. No.: 10/567,105

(22) PCT Filed: Jul. 22, 2004

(86) PCT No.: PCT/JP2004/010398

§ 371 (c)(1),
(2), (4) Date: Feb. 3, 2006

(87) PCT Pub. No.: WO2005/014904

PCT Pub. Date: Feb. 17, 2005

(65) Prior Publication Data

US 2008/0168802 A1 Jul. 17, 2008

(30) Foreign Application Priority Data

Aug. 8, 2003 (JP) ..... 2003-289782

(51) Int. Cl.
*G06F 19/00* (2006.01)
*D04B 15/56* (2006.01)

(52) U.S. Cl. ..... 700/141; 66/127

(58) Field of Classification Search ..... 66/126 R, 66/127, 128, 129, 126 A, 133, 139; 700/130, 700/140, 141

See application file for complete search history.

(56) References Cited

U.S. PATENT DOCUMENTS

| | | | | |
|---|---|---|---|---|
| 3,688,525 | A | 9/1972 | Jeffcoat | |
| 4,052,865 | A * | 10/1977 | Zamarco | 66/128 |
| 6,895,785 | B2 * | 5/2005 | Morita | 66/126 R |
| 6,988,385 | B2 * | 1/2006 | Miyamoto | 66/127 |
| 7,216,513 | B2 * | 5/2007 | Miyai et al. | 66/126 R |
| 7,269,976 | B2 * | 9/2007 | Miyai et al. | 66/127 |

FOREIGN PATENT DOCUMENTS

| | | | |
|---|---|---|---|
| JP | 54-21464 | B2 | 7/1979 |
| JP | 62-50589 | B2 | 10/1987 |
| JP | 2857840 | B2 | 2/1999 |
| JP | 2903152 | B2 | 3/1999 |

* cited by examiner

*Primary Examiner*—Danny Worrell
(74) *Attorney, Agent, or Firm*—Rothwell, Figg, Ernst & Manbeck, P.C.

(57) ABSTRACT

A carriage allows accompaniment of a movable yarn guide as well as a yarn carrier, and accompanies the movable yarn guide with the yarn carrier. If there is a course where the accompaniment of the movable yarn guide is not possible, the movable yarn guide is accompanied beforehand to a position in a preceding course where the accompaniment becomes possible.

13 Claims, 7 Drawing Sheets

FLAT KNITTING MACHINE, KNITTING PROGRAM, AND METHOD FOR GENERATING KNITTING PROGRAM

CROSS REFERENCE TO RELATED APPLICATION

This application is a 35 USC § 371 National Phase Entry Application from PCT/JP2004/010398, filed Jul. 22, 2004, and designating the United States.

TECHNICAL FIELD

The present invention relates to control of a movable yarn guide in a flat knitting machine.

BACKGROUND ART

In a type of flat knitting machine, a movable yarn guide moves along a yarn guide rail, and guides a yarn fed to a yarn carrier. The movable yarn guide is required when the needle bed is long. The movable yarn guide is provided at a position between an end of the yarn guide rail and the yarn carrier for guiding the yarn supplied from a fixed yarn guide to the yarn carrier at a middle position between the fixed yarn guide and the yarn carrier. Thus, slack or swing of the yarn is prevented, and entanglement of yarns is prevented.

According to the disclosure of Japanese Laid-Open Patent Publication No. 58-126351, a pair of left and right movable yarn guides are connected together, and a yarn carrier provided between the movable yarn guides are freely movable without interference with coupling means of the movable yarn guides. When the yarn carrier contacts the movable yarn guide, the yarn carrier pushes, and moves the movable yarn guide. Further, according to the disclosure of Japanese Patent No. 2857840, a movable yarn guide accompanies a yarn carrier.

In the case of Japanese Laid-Open Patent Publication No. 58-126351, the movable yarn guides are not always kept at the desired positions. For example, when the yarn carrier pushes the movable yarn guide, the distance between the yarn carrier and one of the movable yarn guides is too small, and the distance between the yarn carrier and the other of the movable yarn guides is too large. Further, until the yarn carrier contacts the movable yarn guide, though the movable yarn guides are positioned at substantially suitable positions, these positions are not always the optimum positions. For example, assuming that the distance between the pair of movable yarn guides is ½ of the needle bed length, the distances between the movable yarn guides and the yarn carrier fall within the range of 0 to ½ of the needle bed length. However, the range is too wide, and cannot be said as the suitable range. In the case of Japanese Patent No. 2857840, while the yarn carrier accompanies the movable yarn guide, the distance between the yarn carrier and the movable yarn guide is too small. Therefore, it is not possible to accompany the movable yarn guide with the yarn carrier, and perform knitting at the same time. Thus, it is necessary to move the yarn carrier and the carriage only for accompanying the movable yarn guide with the yarn carrier.

SUMMARY OF THE INVENTION

An object of the present invention is to provide a flat knitting machine, a knitting program, and a method of generating the knitting program in which it is possible to simply place a movable yarn guide at a suitable position relative to a yarn carrier.

Another object of the present invention is to make it possible to change the position of a movable yarn guide while knitting using a yarn carrier, and maintaining the minimum distance between the yarn carrier and the movable yarn guide.

A still another object of the present invention is to minimize the movement of a carriage for providing a movable yarn guide at a suitable position.

According to the present invention, a flat knitting machine comprises a yarn carrier and a movable yarn guide provided along a yarn guide rail, and a carriage having accompanying means. The accompanying means is capable of allowing accompaniment of the yarn carrier, and releasing the accompaniment of the yarn carrier, and also capable of allowing accompaniment of the movable yarn guide, and releasing the accompaniment of the movable yarn guide. Control data for the movable yarn guide is provided in a knitting program to control the carriage such that the position of the movable yarn guide is kept within a predetermined range relative to the yarn carrier for allowing the accompaniment of the movable yarn guide by the accompanying means. The control data for the movable yarn guide may be generated or memorized in advance, before starting knitting. Alternatively, the control data for the movable yarn guide may be generated instantly based on control data for the yarn carrier or the like.

It is preferable that the carriage has a plurality of cam systems for operating a needle on a needle bed and a plurality of the accompanying means along a longitudinal direction of the needle bed, and one of the accompanying means along the longitudinal direction of the needle bed accompanies the yarn carrier, and at the same time, another accompanying means accompanies the movable yarn guide. For example, the accompanying means is used for moving both of the yarn carrier and the movable yarn guide. Accompanying means for the accompaniment of the movable yarn guide may be provided at opposite ends of the yarn guide rail of the carriage or the like, in addition to the accompanying means for the yarn carrier.

It is particularly preferable that the position of releasing the accompaniment of the movable yarn guide is selected such that the carriage does not move only for allowing the accompaniment of the movable yarn guide.

Further, it is preferable that the flat knitting machine is further provided with means for converting control data for the yarn carrier in the knitting program into the control data for the movable yarn guide.

According to another aspect of the present invention, a knitting program for use in a flat knitting machine for operating a needle of a needle bed by a carriage and moving a yarn carrier provided in a yarn guide rail is provided. The flat knitting machine comprises the yarn carrier and a movable yarn guide provided along the yarn guide rail, and the carriage having accompanying means. The accompanying means is capable of allowing accompaniment of the yarn carrier, and releasing the accompaniment of the yarn carrier, and also capable of allowing accompaniment of the movable yarn guide, and releasing the accompaniment of the movable yarn guide. Control data for allowing the accompaniment of the movable yarn guide by the accompanying means is provided in the knitting program to control the carriage such that the position of the movable yarn guide is kept within a predetermined range relative to the yarn carrier.

According to still another aspect of the present invention, a method of generating a knitting program for use in a flat knitting machine for operating a needle of a needle bed by a carriage and accompanying a yarn carrier provided in a yarn guide rail by the carriage is provided. The flat knitting machine comprises the yarn carrier and a movable yarn guide provided along the yarn guide rail, and the carriage having accompanying means. The accompanying means is capable of allowing accompaniment of the movable yarn guide, and releasing the accompaniment of the movable yarn guide. Control data for the yarn carrier is provided in the knitting program. The control data for the yarn carrier is converted to generate control data for the movable yarn guide for allowing the position of the movable yarn guide to be kept within a predetermined range relative to the yarn carrier.

ADVANTAGES OF THE INVENTION

In the present invention, the carriage accompanies the movable yarn guide in accordance with the control data for the movable yarn guide in the knitting program. Therefore, the position of the yarn carrier is controlled finely, and the yarn carrier is always kept at a suitable position relative to the yarn carrier. In the structure, it is possible to smoothly feed the yarn to the yarn carrier. Unlike the structure in which the yarn carrier pushes the movable yarn guide to move the movable yarn guide, the suitable distance between the yarn carrier and the movable yarn guide is maintained even during the movement of the movable yarn guide.

In the case where the carriage is provided with a plurality of accompanying means along the longitudinal direction of the needle bed, when one of the accompanying means accompanies the yarn carrier, and the other of the accompanying means accompanies the movable yarn guide, an interval corresponding to the accompanying means is formed between the yarn carrier and the movable yarn guide. The interval roughly corresponds to the interval between the cam systems for operating the needle bed. Thus, while supplying the yarn from the yarn carrier and knitting, it is possible to move the movable yarn guide while maintaining a predetermined interval from the yarn carrier to the movable yarn guide.

Depending on the position of releasing the accompaniment of the movable yarn guide, at the time of the next accompaniment of the movable yarn guide, it may become necessary to move the carriage only for the accompaniment of the movable yarn guide. This occurs when the stroke of the yarn carrier is decreased. When the accompaniment of the movable yarn guide is released in accordance with the preceding stroke, at the time of starting the next accompaniment, if the stroke of the carriage is determined without considering the position of the movable yarn guide, the accompaniment of the movable yarn guide may not be possible. Therefore, by determining the accompaniment release position of the movable yarn guide such that accompaniment can be started without excessive movement of the carriage at the time of next accompaniment of the movable yarn guide, the knitting efficiency does not decrease due to the accompaniment of the movable yarn guide.

For example, the control data for the movable yarn guide may be generated by a knit design apparatus. Alternatively, the control data for the movable yarn guide may be generated by the flat knitting machine. Since the control data for the yarn carrier is included in the knitting program conventionally, based on the control data for the yarn carrier, it is possible to generate the control data for the movable yarn guide simply.

Further, by generating the control data for the movable yarn guide based on the control data for the yarn carrier by the flat knitting machine, using the knitting program which does not include any control data for the movable yarn guide, it is possible to control the movable yarn guide while knitting.

EMBODIMENTS

Figure 1:
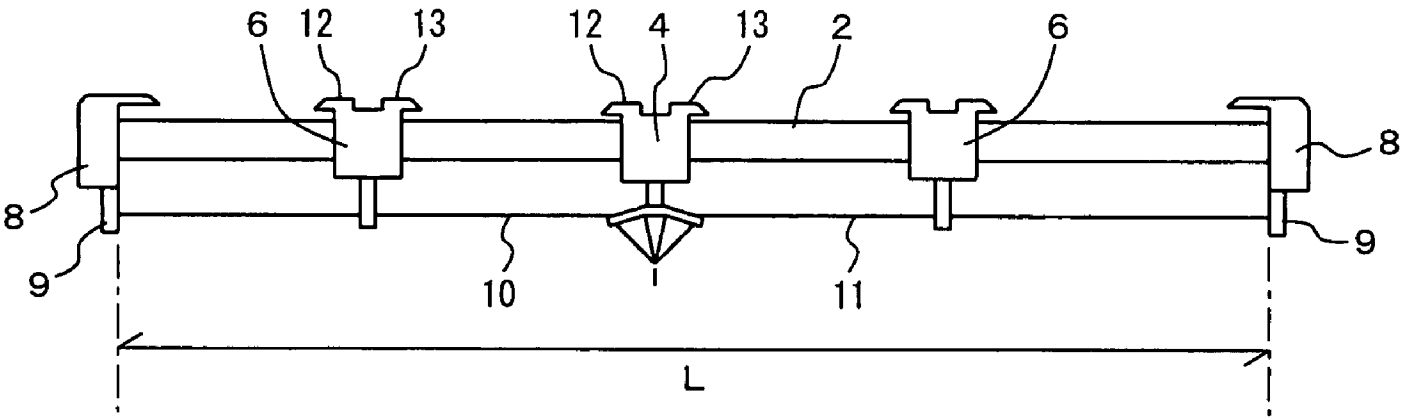
FIG. 1 is a view showing positions of a yarn carrier and movable yarn guides according to an embodiment.

Hereinafter, embodiments in the most preferred form for carrying out the present invention will be described.

An embodiment and its modified embodiment will be described with reference to FIGS. 1 to 7. In the drawings, a reference numeral 2 denotes a yarn guide rail of a flat knitting machine. The yarn guide rail 2 supports a yarn carrier 4 and movable yarn guides 6 for feeding yarns 10, 11 to needles on needle beds such that the yarn carrier 4 and the movable yarn guides 6 are freely movable. Fixed yarn guides 9 are provided at rail ends 8. The movable yarn guides 6 guide the yarns between the fixed yarn guides 9 and the yarn carrier 4. Preferably, each of the movable yarn guides 6 is at substantially the central position between the yarn carrier 4 and the fixed yarn guide 9. The position of the movable yarn guide 6 is not limited to exactly the central position between the yarn carrier 4 and the fixed yarn guide 9, and may be deviated from the central position between the yarn carrier 4 and the fixed yarn guide 9. In the embodiment, the movable yarn guides 6 are controlled based on the assumption that the distance between the movable yarn guides and the yarn carrier is within a predetermined range, and the pair of left and right movable yarn guides do not move beyond the central position of the yarn guide rail. As described above, for example, the pair of movable yarn guides 6 are provided on both left and right sides of the yarn carrier 4. If the yarn guide rail 2 is sufficiently long, a plurality of movable yarn guides 6 may be provided on each of the left and right sides. Alternatively, the movable yarn guide 6 may be provided only on one of the left and right sides. L in FIG. 1 denotes the length of the yarn guide rail 2 which is the same as the length of the needle bed, and equal to the maximum stroke of the carriage in the flat knitting machine. The yarns may be fed to the yarn carrier 4 from both of the left and right sides, and may be fed from only one of the left and right sides. A pair of projections 12, 13 are provided at each of the yarn carrier 4 and the movable yarn guides 6 so that the movable yarn guides 6 may be accompanied the yarn carrier 4 by accompaniment pins of the carriage.

Figure 2:
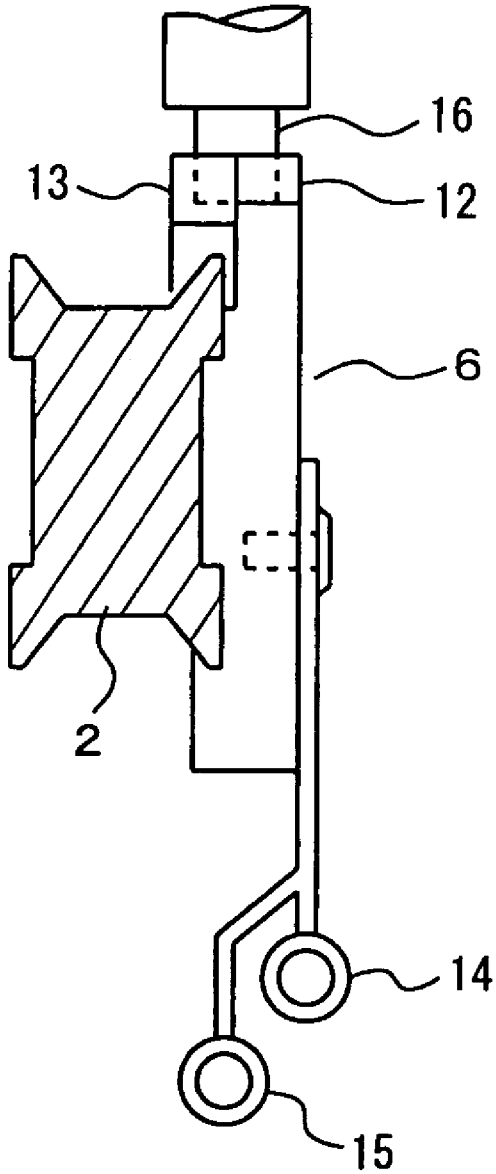
FIG. 2 is a view showing the cross section of a yarn guide rail and the movable yarn guide according to the embodiment.

As shown in FIG. 2, for example, a pair of yarn holes 14, 15 are provided under the movable guide 6. The projection 12 is provided for left movement in FIG. 1, and the projection 13 is provided for right movement. By operation of the accompaniment pin 16 vertically moving by operation of a solenoid (not shown) or the like, it is possible to perform the accompaniment, and release the accompaniment.

Figure 3:
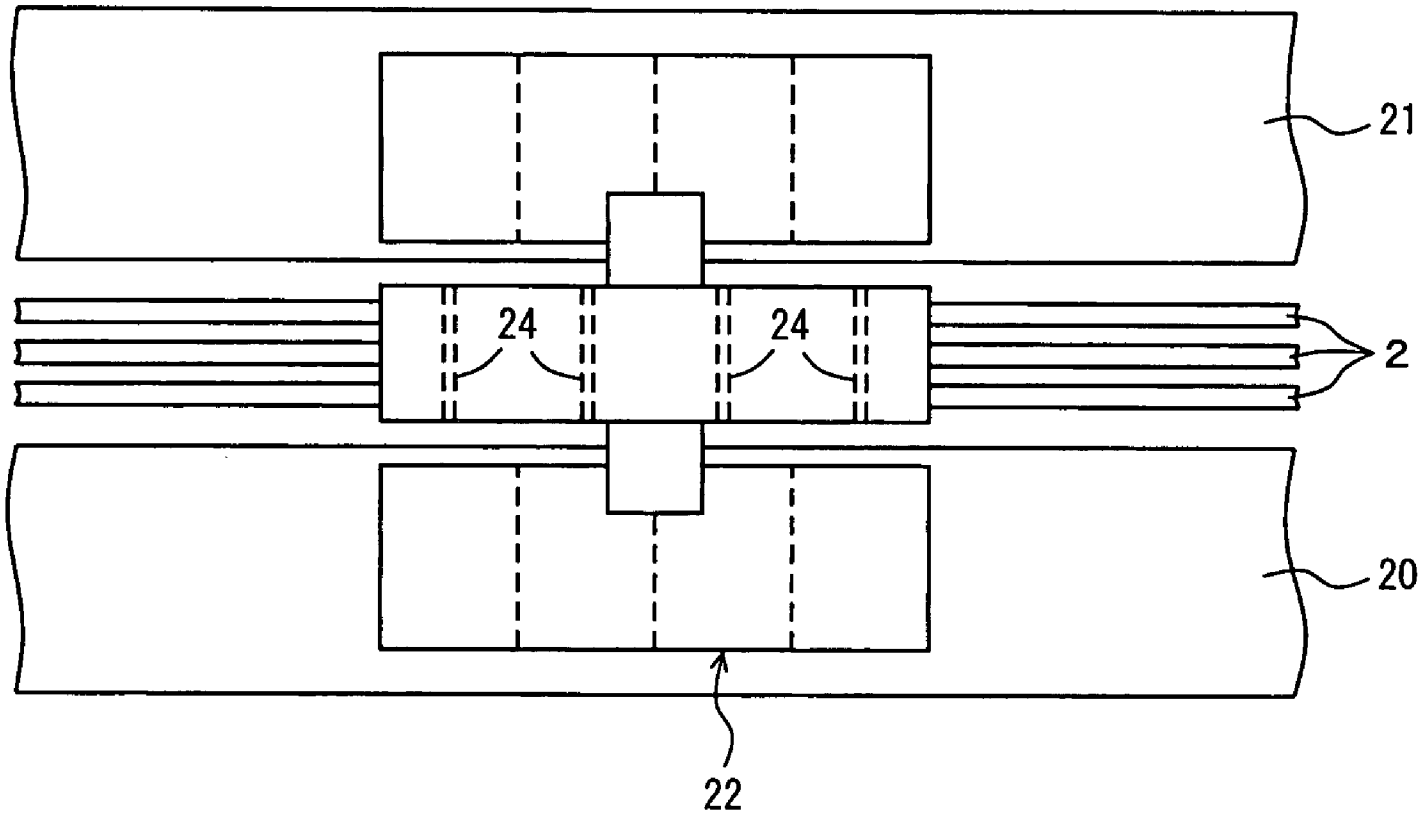
FIG. 3 is a view showing positions of cam systems and accompanying units of a carriage.

Next, referring to FIG. 3, for example, reference numerals 20 and 21 denote a pair of front and back needle beds. A carriage 22 moves back and forth on the needle beds 20, 21 to operate needles on the needle beds. In the embodiment, the carriage 22 is provided with four cam systems for operating the needles on the needle beds. The cam systems are arranged in series in the longitudinal direction of the needle beds 20, 21. Four sets of accompanying units 24 for allowing the accompaniment of the yarn carrier 4 and the movable yarn guides 6 and releasing the accompaniment of the yarn carrier 4 and the movable yarn guides 6 are provided for the respective cam systems. That is, the joint movement units 24 accompany the yarn carrier 4 and the movable yarn guides 6 to the right side or the left side.

In the embodiment, for example, the length L of the needle beds 20, 21 is 80 inches, and for example, the cam systems of the carriage 22 are provided at intervals of 6 inches. Therefore, the joint movement units 24 are also provided at intervals of 6 inches. In the embodiment, the carriage 22 has four cam systems. Alternatively, the carriage 22 may have two cam systems or three cam systems. In another example, two carriages moving on the needle beds are provided separately on the left side and on the right side, one or two cam systems are provided for each of the carriages, and the number of the joint movement units 24 corresponds to the number of the cam systems.

Figure 4:
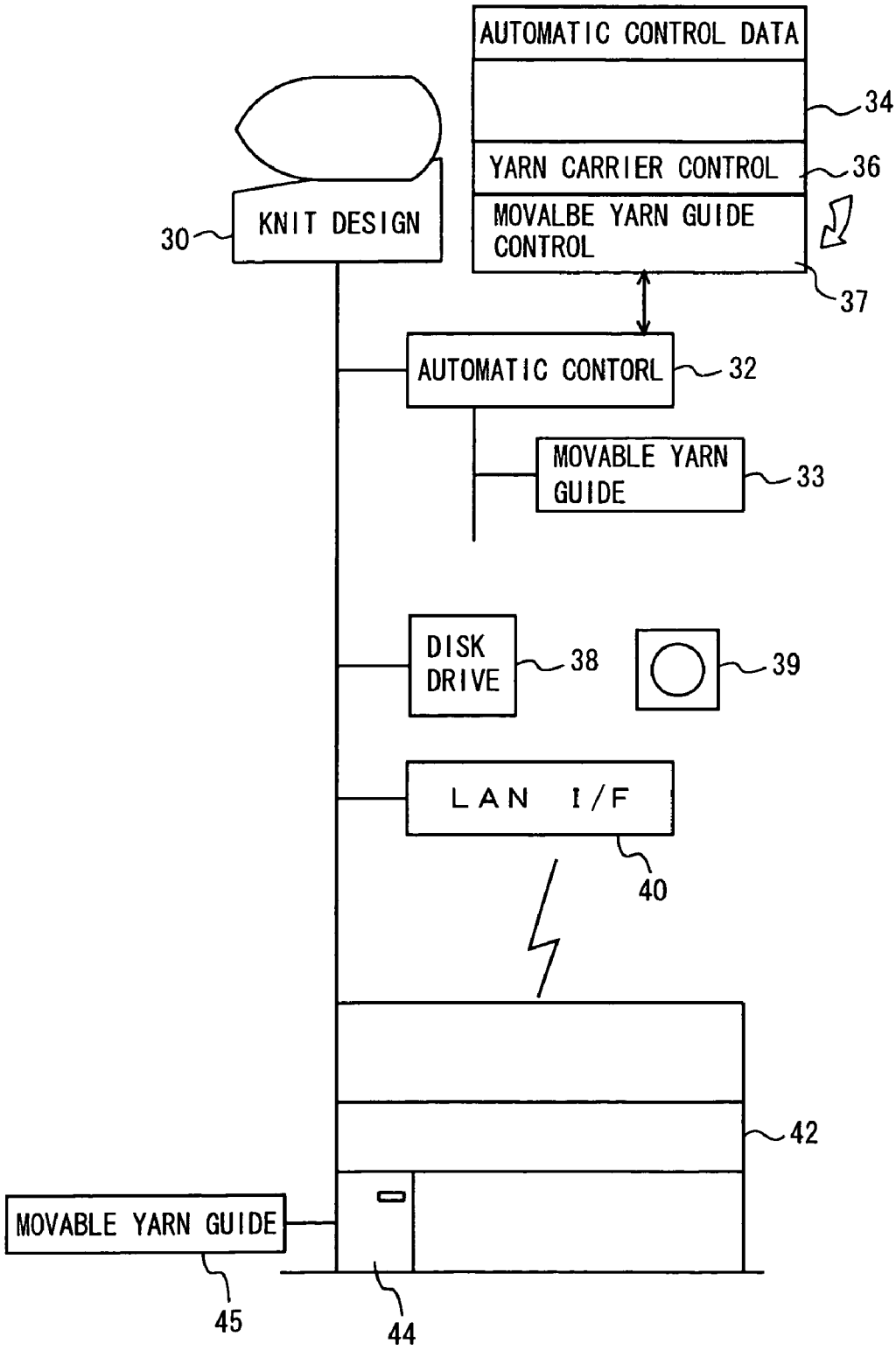
FIG. 4 is a diagram showing structure for generating control data for the movable yarn guide in a knit design apparatus or a flat knitting machine according to the embodiment.

FIG. 4 shows the relationship between generation of a knitting program and the flat knitting machine. A knit design apparatus 30 performs a design for knitting. An automatic control data generation unit 32 converts the designed data for knitting to automatic control data (knitting data) for performing knitting by driving the flat knitting machine 42. The automatic control data 34 includes data of the movement stroke of the carriage, and data for controlling the needle such as needle selection, knit, tuck, miss, and transfer, yarn carrier control data 36 for controlling the yarn carrier, and other various items of data required for knitting a knitted fabric. A movable yarn guide control data generation unit 33 generates movable yarn guide control data 37 based on the yarn carrier control data 36 to control the movable yarn guide on the same yarn path as the yarn carrier to be positioned within a predetermined range from the yarn carrier, and adds the movable yarn guide control data 37 to the automatic control data.

After the movable yarn guide control data 37 is added to the automatic control data, the automatic control data is sent to the flat knitting machine 42 from a disk drive 38 to the flat knitting machine 42 through a suitable disk 39 such as a CD-ROM or a flexible disk, or through a LAN interface 40. A reference numeral 44 denotes a control unit for the flat knitting machine. The control unit 44 operates the carriage or the like in accordance with the automatic control data. Instead of providing the movable yarn guide control data generation unit 33 for the knit design apparatus 30, a similar movable yarn guide control data generation unit 45 may be provided for the control unit 44 of the flat knitting machine 42. The yarn guide control data generation unit 45 generates control data for the movable yarn guide based on the automatic control data which does not include any control data for the movable yarn guide. In this case also, preferably, the control data for the movable yarn guide is generated based on the control data for the yarn carrier to control the movable yarn guide to be positioned within a predetermined range from the yarn carrier.

Figure 5:
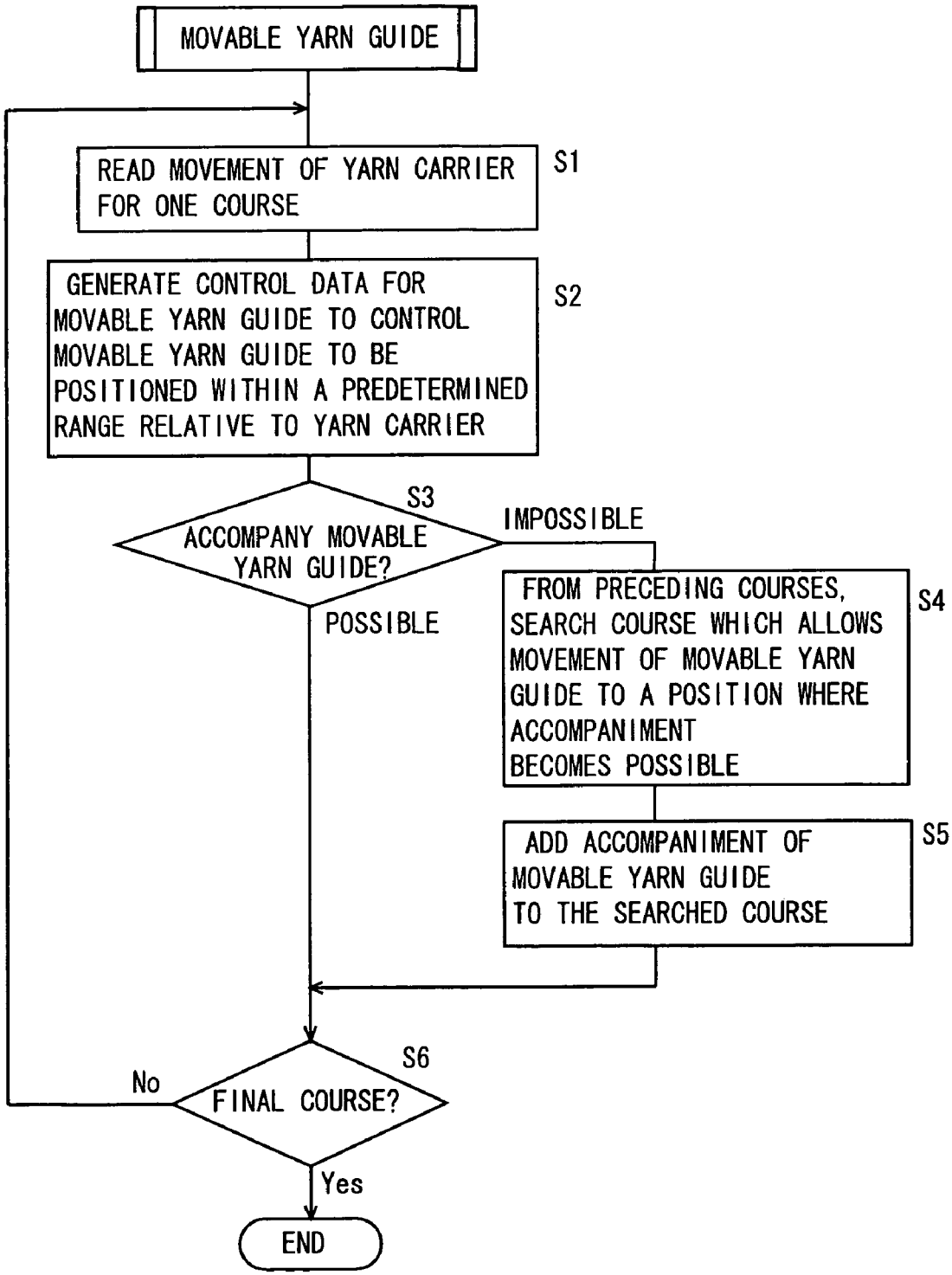
FIG. 5 is a flow chart showing an algorithm for generating the control data for the movable yarn guide according to the embodiment.

FIG. 5 shows an example of a generated algorithm for the movable yarn guide. It is assumed that the control data for the yarn carrier has already been generated. In step 1, the control data (movement range) for the yarn carrier is read for one course. Then, the control data for the movable yarn guide is generated to control the movable yarn guide to be positioned within a predetermined range with respect to the yarn carrier (step 2). Suitable values for the interval between the yarn carrier and the movable yarn guide are determined. For example, the minimum interval between the yarn carrier and the movable yarn guide is 6 inches, and the maximum interval between the yarn carrier and the movable yarn guide is 20 inches. Further, at the end of operation in each course, preferably, the movable yarn guide should be at substantially the central position between the fixed yarn guide and the yarn carrier. It is not absolutely necessary to observe this final rule. For example, it may not be necessary that the movable yarn guide is arranged at substantially the central position between the yarn carrier and the fixed yarn guide if such arrangement increases the stroke of the carriage. In the embodiment, there is a constraint that the movable yarn guide on the left side does not enter the right half of the yarn guide rail, and the movable yarn guide on the right side does not enter the left half of the yarn guide rail.

In the processes of steps 1 and 2, knitting is performed by accompanying the yarn carrier and the movable yarn guide in the same course such that the interval between the yarn carrier and the movable yarn guide is kept within the range of 6 to 20 inches. However, if the position of staring the accompaniment of the movable yarn guide falls outside the movement stroke of the carriage in the course, the accompaniment of the movable yarn guide is not possible. Thus, in step 3, it is determined whether it is possible to accompany the movable yarn guide. If the accompaniment is not possible, a course which allows preliminary movement of the movable yarn guide to a position where the accompaniment can be started is searched, among the preceding courses (step 4). In the knitting program, other than the case where it is the first time to perform the accompaniment of the movable yarn guide, there is a course which allows the accompaniment of the movable yarn guide, among the preceding courses. Therefore, the accompaniment of the movable yarn guide in the searched course is added to the knitting program, so that the accompaniment of the movable yarn guide can be started in the course of step 2 (step 5). In step 6, it is checked whether the movement of the yarn is in the final course or not. When the final course is processed, generation of the control data for the movable yarn guide is finished. In the case where a plurality of yarn carriers are used, the algorithm of FIG. 5 is processed for the control data for the respective yarn carriers.

Figure 6:
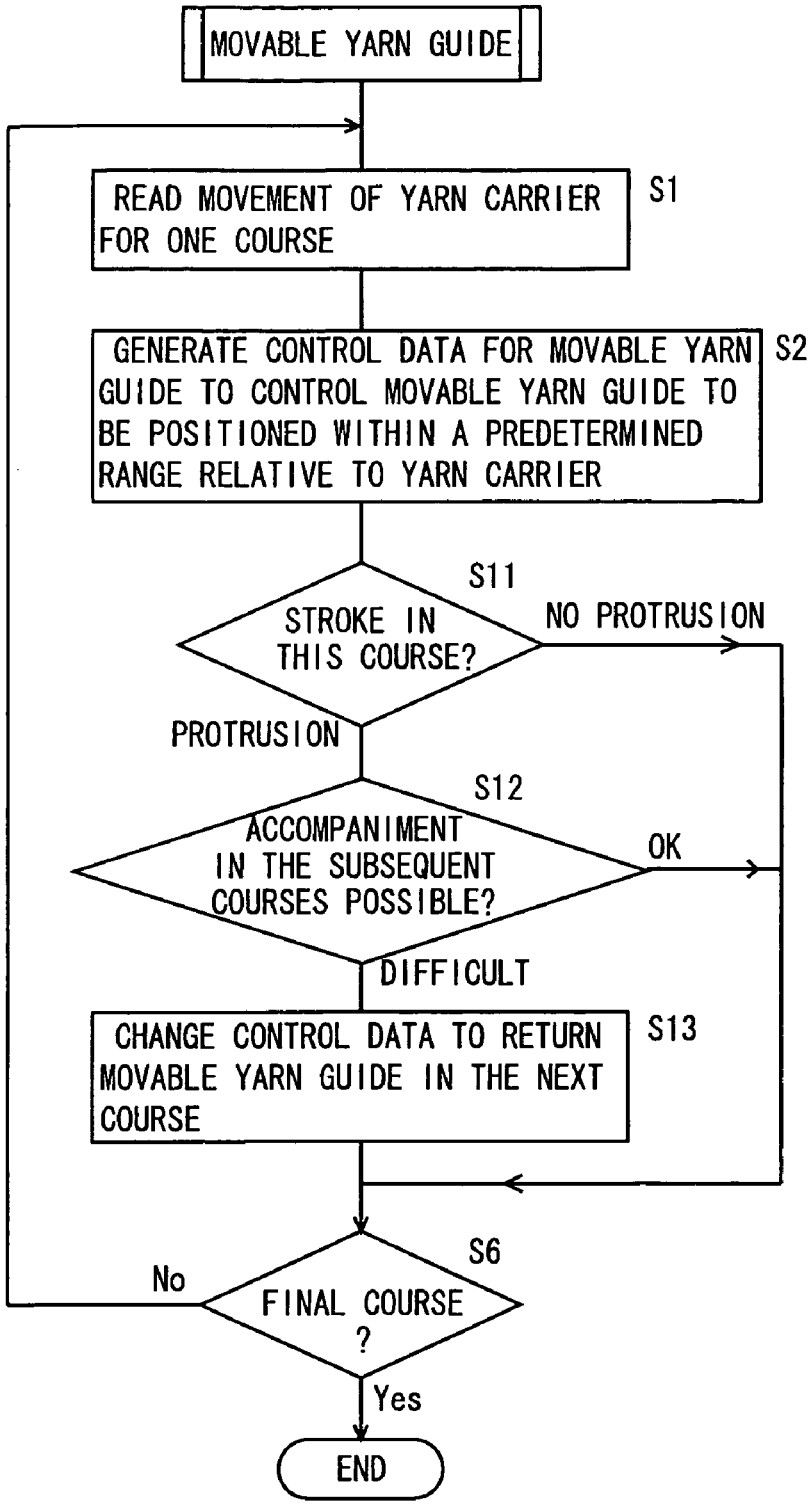
FIG. 6 is a flow chart showing an algorithm for generating the control data for the movable yarn guide according to a modified embodiment.

A problem in the control of the movable yarn guide is that if the position of releasing the accompaniment of the movable yarn guide is not suitable, at the time of starting the next accompaniment, the carriage needs to move only for allowing the accompaniment of the movable yarn guide. In order to eliminate the problem, in the algorithm of FIG. 5, processes of step 4 and step 5 are added. A modification to the algorithm is shown in FIG. 6. Steps 1, 2, and 6 of FIG. 6 are identical to steps 1, 2, and 6 of FIG. 5. In FIG. 6, each time the control data for the movable yarn guide for one course is generated, in step 11, for example, it is determined whether the end of the stroke of the carriage, i.e., the position where the stroke is finished protrudes beyond the end of the subsequent stroke or not. In the case where the end of the stroke protrudes beyond the end of the subsequent stroke, if the accompaniment of the movable yarn guide is released at a position near the end of the stroke, it may not be possible to start the next accompaniment of the movable yarn guide. Therefore, in the case where the end of the stroke of the carriage protrudes beyond the end of the subsequent stroke, at the accompaniment release position temporarily determined in step 2 as described above, it is determined whether the next accompaniment of the movable yarn guide can be started or not (step 12). If there is any problem for starting the accompaniment, in the next course returning from the end of the stroke, the control data for the movable yarn guide is modified to control the movable yarn guide to return toward the center of the knitting width (step 13).

In the algorithm in FIG. 6, whether the stroke of the carriage protrudes or not is determined based on the position where the stroke is finished. Alternatively, whether the stroke of the carriage protrudes or not may be determined based on the end position where the stroke is started. Further, the control algorithms of FIGS. 5 and 6 can be changed as necessary. In the case where accompaniment of the movable yarn guide is not possible, i.e., in the case where the interval between the movable yarn guide and the yarn carrier is too wide at the time of starting a course, the position of the movable yarn guide should be corrected in a preceding course such that the interval between the movable yarn guide and the yarn carrier at the time of starting the course falls within a predetermined range.

Figure 7:
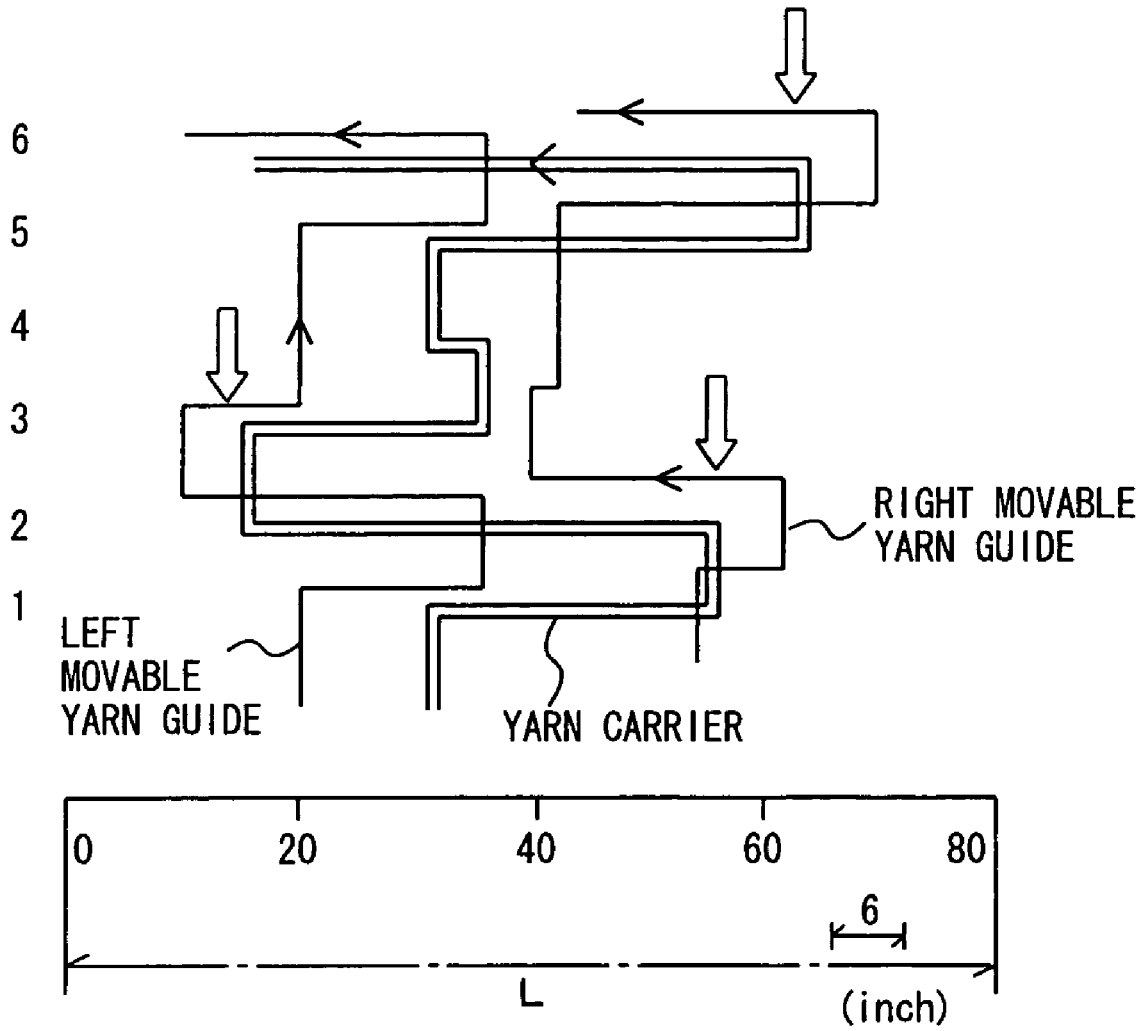
FIG. 7 is a view showing trajectories of the yarn carrier and the movable yarn guides according to the embodiment.

FIG. 7 shows an example of movement strokes of left and right movable yarn guides. The central trajectory represents a trajectory of the yarn carrier. The lengths of the needle beds and the yarn guide rail are 80 inches. Yarns are fed from the left and right yarn guides to the yarn carrier. For example, the interval between the yarn carrier and the movable yarn guide is in the range of 6 to 20 inches. The left and right movable yarn guides do not move beyond the center of the yarn guide rail. For example, the carrier has four systems, and the accompanying unit corresponding to the system at the right end is used for accompanying the right movable yarn guide. The system at the second position from the right end is used for accompanying the yarn carrier. The system at the left end is used for controlling the left movable yarn guide. In the structure, the accompaniment of the right movable yarn guide is started at a position spaced 6 inches from the yarn carrier to the right side, and the accompaniment of the left movable yarn guide is started at a position spaced 12 inches from the yarn carrier to the left side.

In the course 1, the left movable yarn guide is accompanied, and the accompaniment is released at a suitable position. The accompaniment of the right movable yarn guide is started immediately before the end position of the course 1. In this case, at the position near the end position of the course 1, the interval between the left movable yarn guide and the yarn carrier becomes about 20 inches. In the course 2, the right movable yarn guide is accompanied. From a middle position, the left movable yarn guide is also accompanied. The end position of the course 2 protrudes to the left side. Therefore, in the course 3, the left movable yarn guide is accompanied, and the accompaniment is released where the left accompaniment of the movable yarn guide becomes possible in the course 5. In the course 3, the right movable yarn guide moves slightly to the right side such that the minimum interval between the right movable yarn guide and the yarn carrier becomes 6 inches. In the course 5, the left movable yarn guide is accompanied, and then, the right movable yarn guide is accompanied. Since the right end of the course 5 protrudes to the right side, in the course 6, the right movable yarn guide is accompanied so that the next accompaniment will not be inhibited.

Outlined arrows in FIG. 7 indicate portions where the accompaniment of the movable yarn guide in the subsequent courses is taken into account. Assuming that the portions indicated by the outlined arrows are not provided, for example, if the left movable yarn guide is released at a position spaced about 10 inches from the left end of the yarn guide rail in the course 2, the accompaniment of the left movable yarn guide is not possible in the course 5. The accompaniment or the like of the right movable yarn guide in the course 6 is performed in the same fashion as in the case of the course 5.

As described above, in the embodiments, since the carriage accompanies the movable yarn guide, the movable yarn guide is always kept at a suitable position relative to the yarn carrier. Further, the movement of the carriage only for moving the movable yarn guide is not required. Moreover, since the control data for the movable yarn guide is generated based on the control data for the yarn guide, even in the case where the knitting program does not have any control data for the movable yarn guide, the control data for the movable yarn guide can be generated, and the knitting program can be executed on the flat knitting machine using the control data for the movable yarn guide.

BRIEF DESCRIPTION OF THE SYMBOLS

2 yarn guide rail
4 yarn carrier
6 movable yarn guide
8 rail end
9 fixed yarn guide
10,11 yarn
12,13 projection
14,15 yarn hole
16 accompaniment pin
20,21 needle bed
22 carriage
24 accompanying unit
30 knit design apparatus
32 automatic control data generation unit
33,45 movable yarn guide control data generation unit
34 automatic control data
36 yarn carrier control data
37 movable yarn guide control data
38 disk drive
39 disk
40 LAN interface 40
42 flat knitting machine
44 control unit.

The invention claimed is:

1. A flat knitting machine, having a carriage provided along a longitudinal direction of the needle bed with: a plurality of cam systems operating a needle in a needle bed; and a plurality of accompanying means for allowing accompaniment of a yarn carrier and releasing the accompaniment of the yarn carrier, wherein a yarn is fed to the yarn carrier from a fixed yarn guide through a movable yarn guide, the fixed yarn guide provided at an end of the needle bed, the movable yarn guide positioned between the fixed yarn guide and the yarn carrier, and the yarn carrier and the movable yarn guide provided on the same yarn guide rail, and wherein:

first accompanying means among the plurality of accompanying means accompanies the yarn carrier;

the movable yarn guide is structured such that the movable yarn guide can be accompanied by the plurality of accompanying means and the accompaniment of the movable yarn guide can be released by the plurality of accompanying means, and second accompanying means among the plurality of accompanying means accompanies the movable yarn guide and releases the accompaniment of the movable yarn guide; and the second accompanying means is controlled by control data for the movable yarn guide in a knitting program for controlling the carriage such that an interval between the movable yarn guide and the yarn carrier is kept within a predetermined range, and a position of releasing the accompaniment of the movable yarn guide falls within a stroke of the second accompanying means at the time of the next accompaniment of the movable yarn guide.

2. The flat knitting machine of claim 1, wherein by the control data for the movable yarn guide, a lower limit of the predetermined range is set to an interval between the first accompanying means and the second accompanying means, and the movable yarn guide is not accompanied beyond a center of the needle bed.

3. The flat knitting machine of claim 2, wherein the movable yarn guide is moved toward the center of the needle bed with the second accompanying means beforehand in a course where an extent of a protrusion of a position where the carriage starts to move toward the fixed yarn guide is larger than an extent of a protrusion of a position where the carriage starts to move toward the fixed yarn guide in a next course in the same direction as a direction of the course, and at the time of starting the next course in the same direction, the interval between the yarn carrier and the movable yarn guide becomes the interval between the first accompanying means and the second accompanying means or less.

4. The flat knitting machine of claim 1, further comprising means for converting control data for the yarn carrier in the knitting program into the control data for the movable yarn guide.

5. A knitting method with a flat knitting machine, having a carriage provided along a longitudinal direction of the needle bed with: a plurality of cam systems operating a needle in a needle bed; and a plurality of accompanying means for allowing accompaniment of a yarn carrier and releasing the accompaniment of the yarn carrier, wherein a yarn is fed to the yarn carrier from a fixed yarn guide through a movable yarn guide, the fixed yarn guide provided at an end of the needle bed, the movable yarn guide positioned between the fixed yarn guide and the yarn carrier, and the yarn carrier and the movable yarn guide provided on the same yarn guide rail, and wherein:

first accompanying means among the plurality of accompanying means accompanies the yarn carrier;

the movable yarn guide is structured such that the movable yarn guide can be accompanied by the plurality of accompanying means and the accompaniment of the movable yarn guide can be released by the plurality of accompanying means, and second accompanying means among the plurality of accompanying means accompanies the movable yarn guide and releases the accompaniment of the movable yarn guide; and the second accompanying means is controlled by control data for the movable yarn guide in a knitting program for controlling the carriage such that an interval between the movable yarn guide and the yarn carrier is kept within a predetermined range, and a position of releasing the accompaniment of the movable yarn guide falls within a stroke of the second accompanying means at the time of the next accompaniment of the movable yarn guide.

6. The knitting method of claim 5, wherein by the control data for the movable yarn guide, a lower limit of the predetermined range is set to an interval between the first accompanying means and the second accompanying means, and the movable yarn guide is not accompanied beyond a center of the needle bed.

7. The knitting method of claim 6, wherein the movable yarn guide is moved toward the center of the needle bed with the second accompanying means beforehand in a course where an extent of a protrusion of a position where the carriage starts to move toward the fixed yarn guide is larger than an extent of a protrusion of a position where the carriage starts to move toward the fixed yarn guide in a next course in the same direction as a direction of the course, and at the time of starting the next course in the same direction, the interval between the yarn carrier and the movable yarn guide becomes the interval between the first accompanying means and the second accompanying means or less.

8. An apparatus for generating a knitting program for a flat knitting machine, having a carriage provided along a longitudinal direction of the needle bed with: a plurality of cam systems operating a needle in a needle bed; and a plurality of accompanying means for allowing accompaniment of a yarn carrier and releasing the accompaniment of the yarn carrier, wherein:

a yarn is fed to the yarn carrier from a fixed yarn guide through a movable yarn guide, the fixed yarn guide provided at an end of the needle bed, the movable yarn guide positioned between the fixed yarn guide and the yarn carrier, and the yarn carrier and the movable yarn guide provided on the same yarn guide rail;

first accompanying means among the plurality of accompanying means accompanies the yarn carrier; and the movable yarn guide is structured such that the movable yarn guide can be accompanied by the plurality of accompanying means and the accompaniment of the movable yarn guide can be released by the plurality of accompanying means, and second accompanying means among the plurality of accompanying means accompanies the movable yarn guide and releases the accompaniment of the movable yarn guide, and wherein control data for the movable yarn guide is generated such that an interval between the movable yarn guide and the yarn carrier is kept within a predetermined range, and a position of releasing the accompaniment of the movable yarn guide falls within a stroke of the second accompanying means at the time of the next accompaniment of the movable yarn guide by controlling the second accompanying means.

9. The knitting program generation apparatus of claim 8, wherein by the control data for the movable yarn guide, a lower limit of the predetermined range is set to an interval between the first accompanying means and the second accompanying means, and the movable yarn guide is not accompanied beyond a center of the needle bed.

10. The knitting program generation apparatus of claim 9, wherein, by the control data for the movable yarn guide, the movable yarn guide is moved toward the center of the needle bed with the second accompanying means beforehand in a course where an extent of a protrusion of a start position where the carriage starts to move toward the fixed yarn guide is larger than an extent of a protrusion of a position where the carriage starts to move toward the fixed yarn guide in a next course in the same direction as a direction of the course, and at the time of starting the next course in the same direction, an interval between the yarn carrier and the movable yarn guide becomes the interval between the first accompanying means and the second accompanying means or less.

11. A knitting program for a flat knitting machine, having a carriage provided along a longitudinal direction of the needle bed with: a plurality of cam systems operating a needle in a needle bed; and a plurality of accompanying means for allowing accompaniment of a yarn carrier and releasing the accompaniment of the yarn carrier, wherein:

a yarn is fed to the yarn carrier from a fixed yarn guide through a movable yarn guide, the fixed yarn guide provided at an end of the needle bed, the movable yarn guide positioned between the fixed yarn guide and the yarn carrier, and the yarn carrier and the movable yarn guide provided on the same yarn guide rail;

first accompanying means among the plurality of accompanying means accompanies the yarn carrier; and the movable yarn guide is structured such that the movable yarn guide can be accompanied and the accompaniment of the movable yarn guide can be released by the plurality of accompanying means, and second accompanying means among the plurality of accompanying means accompanies the movable yarn guide, and releases the accompaniment of the movable yarn guide, the program comprising control data for the movable yarn guide such that an interval between the movable yarn guide and the yarn carrier is kept within a predetermined range, and a position of releasing the accompaniment of the movable yarn guide falls within a stroke of the second accompanying means at the time of the next accompaniment of the movable yarn guide by controlling the second accompanying means.

12. The knitting program of claim 11, wherein by the control data for the movable yarn guide, a lower limit of the predetermined range is set to an interval between the first accompanying means and the second accompanying means, and the movable yarn guide is not accompanied beyond a center of the needle bed.

13. The knitting program of claim 12, wherein, by the control data for the movable yarn guide, the movable yarn guide is moved toward the center of the needle bed with the second accompanying means beforehand in a course where an extent of a protrusion of a position where the carriage starts to move toward the fixed yarn guide is larger than an extent of a protrusion of a position where the carriage starts to move toward the fixed yarn guide in a next course in the same direction as a direction of the course, and, at the time of starting the next course in the same direction, the interval between the yarn carrier and the movable yarn guide becomes the interval between the first accompanying means and the second accompanying means or less.

* * * * *